US010363576B2

(12) United States Patent
Schenk

(10) Patent No.: US 10,363,576 B2
(45) Date of Patent: Jul. 30, 2019

(54) SCREENING DEVICE AND METHOD FOR SEPARATING DRY GRANULAR MATERIAL

(71) Applicant: Oijense Bovendijk B.V., Oijen (NL)

(72) Inventor: Koos Jacobus Schenk, Oijen (NL)

(73) Assignee: Oijense Bovendijk B.V., Oigen (NL)

( * ) Notice: Subject to any disclaimer, the term of this patent is extended or adjusted under 35 U.S.C. 154(b) by 0 days.

(21) Appl. No.: 15/547,274

(22) PCT Filed: Jan. 29, 2016

(86) PCT No.: PCT/NL2016/050068

§ 371 (c)(1),
(2) Date: Jul. 28, 2017

(87) PCT Pub. No.: WO2016/122323

PCT Pub. Date: Aug. 4, 2016

(65) Prior Publication Data

US 2018/0021816 A1 Jan. 25, 2018

(30) Foreign Application Priority Data

Jan. 29, 2015 (NL) ..... 2014210

(51) Int. Cl.
*B07B 1/22* (2006.01)
*B07B 1/26* (2006.01)
(Continued)

(52) U.S. Cl.
CPC ..... *B07B 1/22* (2013.01); *B07B 1/26* (2013.01); *B07B 1/36* (2013.01); *B07B 1/56* (2013.01); *B07B 2230/04* (2013.01)

(58) Field of Classification Search
CPC .... B07B 1/18; B07B 1/22; B07B 1/24; B07B 1/26; B07B 1/56; B07B 2230/04
(Continued)

(56) References Cited

U.S. PATENT DOCUMENTS 2,027,375 A * 1/1936 Fraser ..... B07B 1/18 209/234
2,702,633 A * 2/1955 Dekanski ..... B07B 1/18 209/287
(Continued)

FOREIGN PATENT DOCUMENTS

CA 2 010 897 A1 8/1990
DE 2015845 A1 10/1971
(Continued)

*Primary Examiner* — Joseph C Rodriguez
(74) *Attorney, Agent, or Firm* — Roberts & Roberts, LLP

(57) ABSTRACT

A screening device for separating dry granular material into a fine fraction and a coarse fraction is provided. The screening device includes a drum screen defined by an open rotatable frame, which frame defines a circumferential wall, and a sheet-like screen arranged over the circumferential wall of the frame. The screening device also includes a driving device by means of which the drum screen is rotatably driven, a feed opening at a short end of the drum screen and a discharge opening at the opposite short end of the drum screen. The screening device further includes a vibration device which rotates along with the drum screen, which vibration device includes one or more vibrating elements mounted to the drum screen, which set the drum screen vibrating in use. A method for separating dry granular material into a fine fraction and a coarse fraction is also provided.

19 Claims, 3 Drawing Sheets

(51) Int. Cl.
*B07B 1/36* (2006.01)
*B07B 1/56* (2006.01)

(58) Field of Classification Search
USPC ..... 209/284, 288
See application file for complete search history.

(56) References Cited

U.S. PATENT DOCUMENTS 3,591,001 A * 7/1971 Quesnel ..... B07B 1/18 209/287
4,184,944 A * 1/1980 Tytko ..... B07B 1/185 209/288
4,533,469 A * 8/1985 Beisel ..... B07B 9/00 209/243
4,636,304 A * 1/1987 Hoppe ..... B07B 1/26 209/287
4,693,879 A * 9/1987 Yoshimura ..... B01D 33/073 423/449.2
5,653,346 A * 8/1997 Frei ..... B01D 33/0346 209/254
8,453,845 B2 * 6/2013 Kising ..... B07B 1/18 209/270
9,073,088 B2 * 7/2015 Walton ..... B07B 1/22
9,370,780 B2 * 6/2016 Nolan ..... B07B 1/56
9,486,835 B2 * 11/2016 Kising ..... B07B 1/40
2018/0078971 A1 * 3/2018 Solenthaler ..... B07B 1/18

FOREIGN PATENT DOCUMENTS

DE 7311935 U 8/1973
DE 3403818 A1 8/1984
DE 10 2012 104577 A1 12/2013
WO 2011/142663 A1 11/2011

* cited by examiner

SCREENING DEVICE AND METHOD FOR SEPARATING DRY GRANULAR MATERIAL

According to a first aspect, the present invention relates to a screening device configured for separating dry granular material into a fine fraction and a coarse fraction, said device comprising a drum screen defined by a substantially open frame that is rotatable about an axis of rotation that extends at least substantially parallel to a central axis of the drum screen, which frame defines a possibly virtual circumferential wall, and a sheet-like screen arranged, for example laid, over the circumferential wall of the frame, which screen has a mesh width that ranges at least substantially between a maximum grain size of grains for the fine fraction and a minimum grain size of grains for the coarse fraction, a driving device by means of which the drum screen is rotatably driven about the axis of rotation in use, a feed opening at a short end of the drum screen, through which dry granular material to be separated is supplied in use, and a discharge opening at the opposite short end of the drum screen, through which the coarse fraction of screened material is discharged in use. The term "dry granular material" as used herein is understood to mean grains which are at least so dry that they will hardly stick together, if at all, under the influence of the presence of moisture. Also material having a moist consistency like soil may be interpreted as a dry granular in this document. Furthermore, the terms "fine fraction" and "coarse fraction" as used herein are understood to mean an amount of relatively small grains filtered from the feed material, respectively an amount of relatively large grains discharged through the discharge opening.

Such screening devices are known, they are used for separating relatively coarse grains and relatively fine grains of a dry granular material. Dry granular material to be screened is introduced into the rotating drum screen through the feed opening. During rotation, the material to be screened slides, as it were, from the feed opening over the sheet-like screen in the form of a screen cloth having a specific mesh size in the direction of the discharge opening. During said displacement, grains having a grain size smaller than the mesh width of the screen fall through the meshes of the screen cloth and out of the drum screen. The remaining part of the material, comprising relatively coarse granular material and possibly a remainder of relatively large grains that have not fallen through the screen (yet), is led toward the discharge opening and will eventually fall through the discharge opening and out of the drum screen.

A drawback of the known screening device is that the material gradually slides over the screen cloth during rotation of the drum screen and a relatively large portion of the fine granular material does not fall through the screen cloth and is discharged through the discharge opening along with the relatively coarse granular material. Moreover, the screen cloth easily gets clogged as a result of the presence of grains having a grain size that corresponds to the mesh width in the meshes of the screen cloth or as a result of slightly larger grains getting stuck in meshes.

Accordingly it is an object of the present invention to provide a screening device as described in the introduction, by means of which a better separation of the material to be separated can be realised than with the known screening device. According to the present invention, this object is achieved with a screening device as defined in claim 1. By setting the drum screen vibrating by means of the one or more vibrating elements, the material in the drum screen is conveyed more dynamically over the sheet-like screen toward the discharge opening. It "jumps" over the sheet-like screen rather than slides thereover as happens in the known screening device. As a result of the relatively dynamic behaviour, the material to be screened is shaken on the sheet-like screen, more so than in the known screening device, so that there is a greater chance that a relatively small grain will fall through a mesh in the sheet-like screen. The object aimed at is thus achieved with the present invention. Moreover, a vibration device that rotates along with the drum screen causes grains which are present in meshes of the screen and thus clog the screen to be vibrated out of the screen when the respective part of the screen is located (upside down) at the upper side of the rotating drum screen.

According to the present invention, the vibration device comprises vibrating elements which are mounted to the drum screen. This has the advantage that it makes it possible, by positioning the vibrating elements on the drum screen, to determine the locations where the drum screen will be set vibrating in use. A suitable distribution of the vibrating elements over the drum screen can contribute toward achieving an optimum vibration as well. Moreover, a good connection between the vibrating elements and the drum screen can be effected, and a good connection will prevent the occurrence of transmission losses upon transmission of the vibration from the vibrating elements to the drum screen. An important advantage is obtained by a combination of a rotating drum screen, i.e. a drum screen which rotates through 360 degrees in use, and vibrating elements which are mounted to the drum and thus rotate along with the drum screen. In particular in the case of fine-meshed screens there is a risk that particles having a particle size which corresponds more or less to that of the meshes of the screen will get stuck in a mesh. When this happens, the screen will get (partially) clogged. When subsequently the drum rotates 180 degrees, and the part in question of the screen is oriented "upside down", and a vibrating element which, by vibrating, contributes to the screening process, has rotated along with the drum screen, the upper part of the drum will be set vibrating in this position as well. This helps to achieve that a particle that has got stuck in a mesh will be vibrated loose in the rotated (180 degrees) position and fall down. That is, onto the inner side located at the bottom side of the drum, where screening takes place. The combination of a rotating drum screen and vibrating elements mounted to the drum thus provides a screen-cleaning effect.

The vibration device preferably comprises at least two or more vibrating elements, which are preferably distributed at regular intervals over the drum screen between two adjacent vibration devices. During operation, the vibrating elements preferably vibrate in a direction perpendicular to the axis of rotation of the drum screen. The vibrating elements may vibrate continuously in use, but they may also vibrate intermittently, in which case they preferably vibrate when they are located in the upper part or the lower part of a circle of rotation described by the drum screen.

The vibrating elements may be provided on the outer side of the drum screen. However, this could lead to contamination at the moment when a vibrating element is located at the bottom side of the rotating drum screen and relatively fine granular material falls through the membrane onto a vibrating element. It is preferable in that case that the vibrating element are provided on the inner side, i.e. in the interior of the drum screen.

In order to be able to separate dry granular material into a fine fraction and a coarse fraction by screening, the mesh width of the membrane preferably falls within a range that corresponds to the limit values of the respective grain sizes of the coarse fraction and the fine fraction. For crushed concrete said range varies between 1.0-1,000 μm, preferably between 5.0-500 μm. In the case of the separation of crushed concrete into the original materials, such as cement stone and sand, the mesh width preferably ranges between 50 μm and 100 μm. This depends on the grain size of the materials that were originally processed into the concrete. In the Netherlands, the grain size of sand is typically about 63 μm. In Germany it is less than 60 μm. The grain size of unhydrated cement is less than 60 μm. The grain sizes have a normal distribution. Depending on the desired purity of the two outgoing material flows, the mesh width can be selected at a value on or, on the contrary, slightly beside the line of intersection of the two distributions of two substances to be separated.

In a preferred embodiment of the present invention, the vibration device is configured to vibrate at a frequency in the ultrasonic range. A vibration device that vibrates at an ultrasonic frequency and an associated amplitude has the advantage that the vibration frequency is relatively high and the amplitude relatively low. Such a frequency is suitable for screening very fine particles, for example having a particle size of less than 5000 μm, or 1000 μm. In a preferred embodiment of the present invention, a vibration frequency of 50 Hz can already be effective. Furthermore preferably, the vibration frequency may be higher than 1000 Hz. The selection of the frequency depends on the material that is to be set vibrating in order to obtain an effective screening result, in particular the material that is expected to fall through the meshes in the screen. The ultrasonic vibration range has been found to be efficient in separating sand and hydrated cement.

If the screening device comprises guide means which guide material in the drum screen in a conveying direction from the feed opening to the discharge opening during rotation of the drum screen, it is possible to determine the residence time of relatively coarse granular material in the screen. In the case of a rotating drum screen this can for example be realised by a combination of the pitch of a guiding device and the rotational speed of the drum screen. It is conceivable that the guide means form part of the frame of the drum and/or conversely. Thus, the frame may comprise a helical metal wire or metal strip provided on the inner wall of the drum screen, which drives material present on the screen in the direction of the discharge opening during rotation.

In a preferred embodiment of the present invention, the axis of rotation extends at an angle which ranges from −15° to +15° relative to the horizontal, preferably it actually extends horizontally. A horizontal arrangement provides a good adjustability of the residence time of material in the rotating drum screen. A deviation within the range of −15° to +15° from the horizontal, i.e. viewed from the feed opening in the direction of the discharge opening, increases and decreases, respectively, the residence time of material in the rotating drum screen, because the force of gravity opposes or supports the through-flow of the material from the feed opening in the direction of the discharge opening. Because the material is set vibrating by the vibration device, the increasing or decreasing effect on the residence time is enhanced.

In a preferred embodiment of the present invention, the drum screen is provided with a hollow drive shaft for rotatably driving the drum screen. It is preferable in that case that the wiring for driving the vibration device extends through the hollow shaft. In this way damage to the wiring caused by twisting during rotation is prevented.

To realise a proper transmission of the energy for driving the vibrating elements, one or more sliding contacts are preferably provided for energising the vibration device via the wiring. The sliding contacts can engage the rotating drive shaft. This, too, prevents twisting of the wiring. The sliding contacts may be configured for continuous contact during rotation of the drum screen. Alternatively, the sliding contacts may make intermittent contact during rotation of the drum screen, such that a vibrating element will vibrate when located in an upper part or a lower part of a circle described by the vibrating element in question during rotation of the drum screen. Alternatively, energisation may preferably be realised through induction or another form of contactless energy transmission.

In a preferred embodiment of the present invention, the frame defines a cylindrical wall. If the cylindrical frame is enveloped in a sheet-like screen and the drum screen thus formed is rotated, the material to be screened is thus gradually carried over the screening surface of the rotating drum screen. Alternatively, the drum may have an unround cross-section, such as an oval cross-section or a polygonal cross-section. In the case of an oval cross-section, the material is also carried more or less gradually over the surface of the screen. In the case of a polygonal cross-section, the material to be screened will tumble more over the inner side of the screen during rotation of the drum screen than in the case of a round or an oval cross-section.

In a preferred embodiment, the sheet-like screen is made up of a screen cloth. Also other sheet-like screen elements may be arranged around the frame, of course, for example a screen gauze or perforated sheet metal. In a special embodiment, the frame may form an integral part of the sheet-like screen material, for example in the case of a perforated metal sheet bent to a round shape, which has an inherent shape stability.

If the screening device comprises a heating device, by means of which material to be screened can be heated and thus dried in use, sticking together of granular particles as a result of the presence of moisture can be prevented, or at least the risk of that can be reduced. This has a positive effect on the screening result.

In a preferred embodiment of the present invention, the heating device comprises a heating wire that is wound around the drum screen. The heating wire could for example be located in a cavity in an outer edge of a helical strip that defines the drum screen. This is a very simple arrangement, not very susceptible to malfunction, for heating material that is present inside the drum screen.

In a preferred embodiment of the present invention, the drum screen is surrounded by a housing. In particular when a relatively fine fraction is to be separated from material to be screened, this can lead to dust formation of the relatively fine granular material in the dynamic environment (i.e. swirled-up air) of the rotating screen. The housing thus ensures that the surroundings of the drum screen are contaminated as little as possible by dust formed in this way. The housing may for example be made up of a box-like encasing of sheet metal or plastic.

In a preferred embodiment of the present invention, the screening device comprises a feeding device for conveying material to be screened to the feed opening. The feeding device may be a continuous feeding device. Alternatively, or additionally, the feeding device may comprise a metering device for the metered, possibly intermittent, supply of material to be screened to the feed opening.

According to a second aspect, the present invention relates to a method for separating dry granular material into a fine fraction and a coarse fraction. The object aimed at with the method according to the present invention is to achieve advantages corresponding to those discussed above with reference to the screening device. In order to achieve that object, the method according to the present invention comprises the steps of:

a) supplying dry granular material to be separated to a feed opening on a short side of a drum screen which rotates about an axis of rotation that extends substantially horizontally or at an angle deviating by at most 15 degrees from the horizontal and which is provided with a screen wall having a specific mesh width;

b) conveying material present in the drum screen from the feed opening in the direction of a discharge opening located on a short side opposite the feed opening during rotation of the drum screen, during which transport relatively fine granular material falls through the screen wall into the drum screen, and c) discharging relatively coarse granular material at the discharge opening, wherein a vibration device that rotates along with the drum screen, which vibration device comprises one or more vibrating elements mounted to the drum screen, sets the drum screen vibrating in step b).

In a preferred embodiment of the present invention, the rotating drum screen forms part of a screening device according to the first aspect of the present invention.

The present invention will now be discussed in more detail with reference to the appended figures of preferred embodiments of a screening device according to the present invention, in which.

Figure 1:
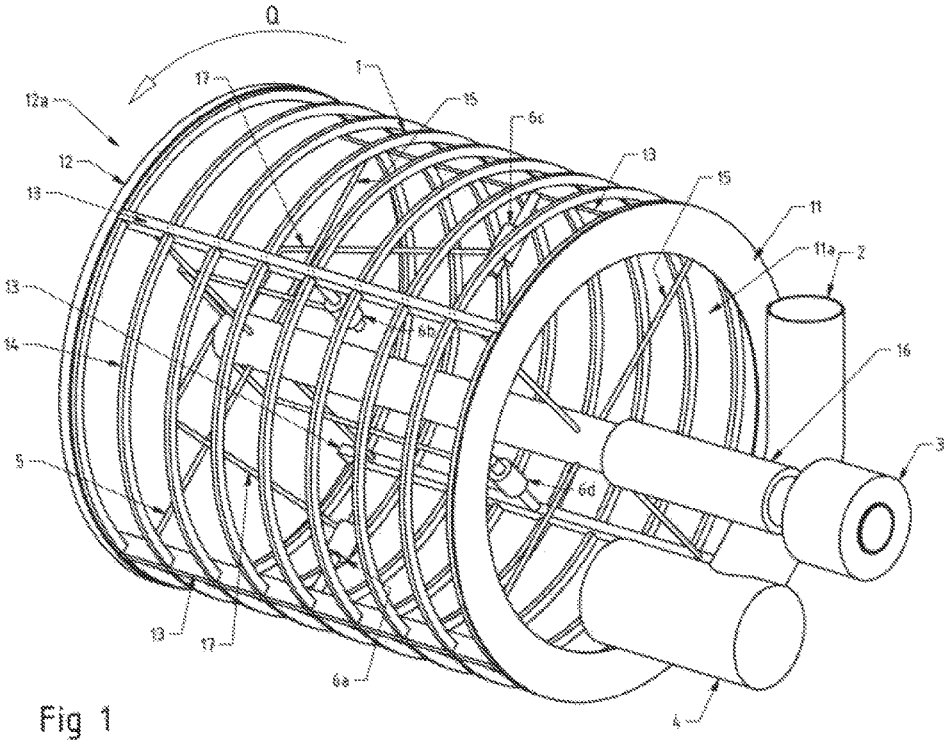
FIG. 1 is a perspective side view of a part of a screening device according to the present invention.

With reference now to FIG. 1, there is shown a perspective view of a screening device according to the present invention, a housing of which has been left out of the figure. The screening device of FIG. 1 comprises a drum screen 1, which is defined by a ring 11, which defines a feed opening 11*a*, a ring 12, which defines a discharge opening 12*a*, four elongate connecting elements 13 (only three of which are shown in FIG. 1), which extend between the ring 11 and the ring 12, and a spiral wound frame element 14 defining a cylinder, which is formed by arches extending between the respective connecting elements 13. The rings 11, 12, the connecting elements 13 and the frame elements 14 jointly form a frame of the drum screen 1. Stretched around the arches is a metal screen mesh as a sheet-like screen having a mesh width that corresponds to the material to be screened, in this case 60 μm. The screen mesh 19 is only shown in part in FIG. 1. A hollow drive shaft 16, which extends horizontally in this exemplary embodiment, is connected, via connecting rods 5, to the connecting elements 13 as a rotary shaft forming part of a driving device (not shown). Provided on the side of the end at the feed opening is a slip ring construction 3 which is connected, via wiring (not shown in FIG. 1) within the hollow drive shaft 16 and connecting pieces 17, to vibrating elements 6 of a vibration device so as to cause them to vibrate at a frequency in the ultrasonic range. Located near the feed opening defined by the ring 11 is a supply pipe 2 for material to be screened. The supply pipe opens into the drum screen 1 via a metering device 4, which extends beyond the ring 11 to within the drum screen 1.

During operation, granular material to be screened by the screening device is introduced into the drum screen 1 via the supply pipe 2 and the metering device 4 and through the feed opening 11*a*. The material to be separated may consist of crushed concrete, for example, in particular concrete that has been crushed into its original materials, viz. pebbles, sand and cement, from which the pebbles have already been removed. The granular material may for example have been obtained by means of crushing device, using the method described in WO 2011/142663, page 9, line 7—page 13, line 34. In the drum screen 1, the granular material to be screened drops onto the inner side of the screen mesh 19. The drive shaft 16 is rotatably driven and in turn drives the drum screen 1 in the direction indicated by arrow Q, so that granular material to be screened is conveyed over the screen mesh 19 in the direction of the discharge opening 12*a* by the frame element 14. Via the slip ring construction 3, wiring (not shown) extending from the slip ring 3 through the hollow drive shaft 16 and the connecting pieces 17, the vibrating elements 6 are energised and set vibrating. The vibrating elements 6 transmit a vibrating motion to the drum screen 1. The vibrating elements 6 are mounted to the connecting elements 6 and thus rotate along with the rotating drum screen 1. In FIG. 1, the vibrating element 6*a* is present on a lower part (in this figure) of the drum on which material to be screened is present. By causing the vibrating elements 6*a*-6*d* to vibrate during rotation of the drum screen 1, the screen mesh 19 is also set vibrating. Granular material to be screened that is present on the screen mesh 19 is thus set in motion in a direction perpendicular to the screen mesh, so that a more effective separation can take place. The person skilled in the field of screening granular material may be presumed to know that vibrating a screen bottom will contribute toward obtaining a good separation of material to be screened. In FIG. 1, the vibrating element 6*c* is present on an upper part (in this figure) of the drum screen 1. Vibration of the vibrating element 6*c* will cause granular material which sticks to the screen mesh 19 at the bottom side of the drum screen 1 or is stuck in the mesh of the screen mesh 19, and which has been carried along with the screen mesh 19 in upward direction, to come loose from the screen mesh 19, so that the meshes will be open again when they are present at the bottom of the drum screen 1 again (after a half revolution) and material to be screened is present thereon. This, too, contributes toward obtaining a better through-flow through the meshes in question of relatively small particles of granular material to be screened. The grains from the material to be screened that are larger than the meshes of the screen mesh 19 are conveyed in the direction of the discharge opening 19 by the frame element 14 during rotation of the drum screen 1, at which discharge opening the relatively coarse granular material drops from the drum screen 1 and is discharged through a discharge opening (not shown in FIG. 1) of a housing of the screening device.

Figure 2:
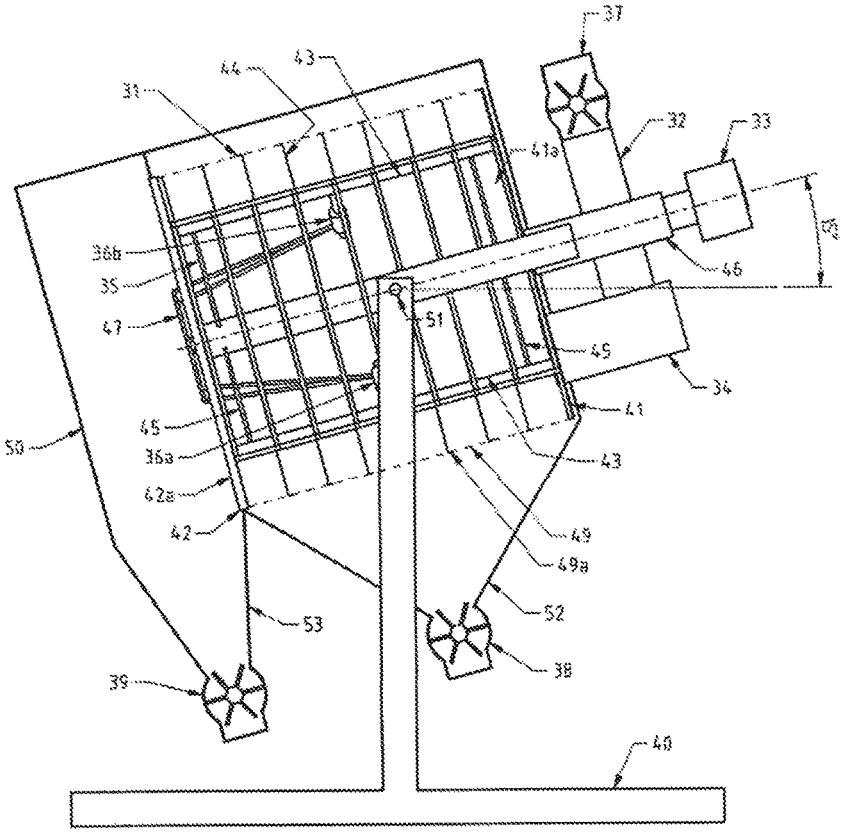
FIG. 2 is a schematic side view of an alternative embodiment of a screening device according to the present invention.

FIG. 2 shows in schematic side view an alternative embodiment of a screening device according to the present invention. In FIG. 2, elements corresponding to elements from the screening device shown in FIG. 1 are indicated by the same reference numerals incremented by 30. FIG. 2 shows the screening device including a housing 50. Such a housing may also be provided around the drum screen 1 of FIG. 1. It is a casing made of metal or of plastic material, for example, which fully surrounds the drum screen 31, so that granular material that comes to float in the air during screening cannot, or at least not easily, find its way into the atmosphere surrounding the screening device other than through discharge openings 38, 39 specially provided for that purpose. The drum screen 31 of FIG. 2 is different from the drum screen 1 of FIG. 1 in that the frame element 14 is not spiral-shaped, but is configured as endless, annular arch elements 44 extending parallel to each other. The arch elements coincide with the inner wall of the drum so as not to form obstacles to material being conveyed toward the discharge opening 42*a*. The device shown in FIG. 2 is further different from the device shown in FIG. 1 in that the drum screen is pivotally connected to a tilting frame 40 via a tilt axis 51 and slopes down at an angle of inclination of 15° from the feed opening 41 to the discharge opening 42. The angle of inclination can be set between −15° and +15°.

In use, granular material to be screened, in this example comprising unhydrated cement having a grain size <60 μm and sand having a grain size >63 μm, respectively, is introduced into the drum screen 31 via a supply pipe 32 and a metering device 34 and through a feed opening provided with a rotary lock 37. In the drum screen 31, the material to be screened drops onto a screen cloth 49 having a mesh size of 60 μm, which is stretched around frame elements 44 and which is schematically indicated by means of a dotted line so as to symbolically represent meshes 49*a* in the screen cloth 49. The screen cloth 49 has been left out in FIG. 2 so as to provide a good view of other parts. It is stretched around the arch elements 44 of the drum screen 31 along the entire length of the drum screen 31. As a rule, the meshes 49*a* will be very small, but this depends on the composition of the material to be screened and on the difference in grain size between the fine fraction and the coarse fraction to be separated by the screening device. With the device shown in FIG. 3, material to be screened that has been introduced into the drum 31 is carried in the direction of the discharge opening 42, partially under the influence of the force of gravity, during rotation of the drum 31 driven by the hollow drive shaft 46. During this displacement, relatively small grains, mainly cement, will fall through the mesh screen 49 into the hopper 52. Relatively large grains, mainly sand, which do not fall through meshes of the screen cloth 49, are collected in the hopper 53. Relatively fine granular material (cement) that has fallen through the screen cloth 49 is subsequently discharged from the housing 50 via the rotary lock 38. Relatively coarse granular material (sand) that has not fallen through the screen cloth is discharged by the rotary lock 39. It will be understood that the vibrating elements 36*a*, 36*b* (and the vibrating elements 36*c*, 36*d*, which are not shown) have a positive effect on the screening result in the same manner as described with reference to FIG. 1.

Figure 3:
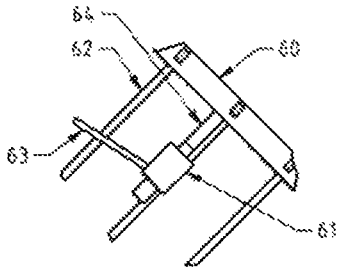
FIG. 3 is a perspective view of a vibrating element mounted to a screening device according to the present invention.

FIG. 3 shows in perspective view a vibrating element 61 mounted to a screening device according to the present invention. Numeral 60 indicates a connecting element comparable to the connecting element 13, 43 of FIGS. 1 and 2. Attached to the part of the connecting element 60 that is shown in FIG. 3 are three sections 62 of a frame element (see 14, 44 in FIGS. 1 and 2). Furthermore, a spacer 64 is welded to the connecting element 60, to which spacer a vibrating element 61 is connected, which vibrating element is energised via a power supply that extends to the vibrating element 61 via a connecting piece 63 (see 17, 47 in FIGS. 1 and 2. In use, the vibrating element 63 is energised, so that it will vibrate at a frequency in the ultrasonic range. Via the spacer 64, the vibrating motion of the vibrating element 61 is transmitted to the connecting element 60, and thus to the drum screen of a screening device of which the drum screen forms part. In the present example, a vibration device is used which vibrates at a frequency in the ultrasonic range and which has an output of 50-16,000 Watt. The invention is not limited to this range, which partially overlaps the ultrasonic range.

In the figures and the above description the present invention is shown and described with reference to two embodiments thereof. It will be apparent that the scope of the invention is not limited to these embodiments, but that many variants, which may or may not be obvious to the skilled person, are conceivable within the scope of the present invention as defined in the appended claims. Thus it is conceivable to use a flexible screen cloth or any other known type of screen having a suitable mesh size instead of a metal screening wall.

In the figures and the above description, the present invention is shown and described with reference to the use thereof in a screening device for separating or screening particles of cement and sand from crushed concrete. This should not be interpreted as being limitative, either. On the contrary, the range of application concerns all dry granular materials having different grain sizes, and in particular grain sizes whose (normal) distributions do not differ much from each other or overlap to a "small" extent, since the meshes cannot be made much larger than the grain size of the small fraction and the risk of clogging is relatively great.

The invention claimed is:

1. A screening device configured for separating dry granular material into a fine fraction and a coarse fraction, said device comprising:

a drum screen defined by a substantially open frame that is rotatable about an axis of rotation that extends at least substantially parallel to a central axis of the drum screen, which frame defines a circumferential wall, and a screen arranged over the circumferential wall of the frame, which screen has a mesh width that ranges at least substantially between a maximum grain size of grains for the fine fraction and a minimum grain size of grains for the coarse fraction, a driving device by means of which the drum screen is rotatably driven about the axis of rotation in use, a feed opening at a short end of the drum screen, through which dry granular material to be separated is supplied in use, and a discharge opening at the opposite short end of the drum screen, through which the coarse fraction of screened material is discharged in use, and a vibration device which rotates along with the drum screen, which vibration device comprises one or more vibrating elements mounted directly onto the drum screen, which set the drum screen vibrating in use, wherein the vibration device is configured to vibrate at a frequency in the ultrasonic range.

2. The screening device according to claim 1, wherein the one or more vibrating elements are mounted directly onto an inner side of the drum screen.

3. The screening device according to claim 1, wherein the mesh width ranges between 1.0-1,000 μm.

4. The screening device according to claim 1 further comprising guide means which guide material in the drum screen in a conveying direction from the feed opening to the discharge opening during rotation of the drum screen, wherein the guide means comprise a spiral present on the inner side of the drum screen.

5. The screening device according to claim 1 wherein the axis of rotation extends at an angle which ranges from −15° to +15° relative to the horizontal.

6. The screening device according to claim 1 wherein the drum screen is provided with a hollow drive shaft for rotatably driving the drum screen, wherein wiring for driving the vibration device that rotates along with the drum extends through the hollow shaft.

7. A screening device configured for separating dry granular material into a fine fraction and a coarse fraction, said device comprising:

a drum screen defined by a substantially open frame that is rotatable about an axis of rotation that extends at least substantially parallel to a central axis of the drum screen, which frame defines a circumferential wall, and a screen arranged over the circumferential wall of the frame, which screen has a mesh width that ranges at least substantially between a maximum grain size of grains for the fine fraction and a minimum grain size of grains for the coarse fraction, a driving device by means of which the drum screen is rotatably driven about the axis of rotation in use, a feed opening at a short end of the drum screen, through which dry granular material to be separated is supplied in use, and a discharge opening at the opposite short end of the drum screen, through which the coarse fraction of screened material is discharged in use, and a vibration device which rotates along with the drum screen, which vibration device comprises one or more vibrating elements mounted to the drum screen, which set the drum screen vibrating in use, wherein the vibration device is configured to vibrate at a frequency in the ultrasonic range, and wherein one or more sliding contacts are provided for energising the vibration device via wiring.

8. The screening device according to claim 1 wherein the frame defines a cylinder.

9. The screening device according to claim 1 wherein the screen comprises a screen cloth.

10. The screening device according to claim 1 wherein the screening device comprises a heating device that is wound around the drum screen.

11. The screening device according to claim 1 wherein the drum screen is surrounded by a housing.

12. The screening device according to claim 1 wherein the screening device comprises a feeding device for conveying material to be screened to the feed opening, which feeding device comprises a metering device for the metered supply of material to be screened to the feed opening.

13. A method for separating dry granular material into a fine fraction and a coarse fraction, comprising the steps of:

a) supplying dry granular material to be separated to a feed opening on a short side of a rotating drum screen provided with a screen wall having a specific mesh width;

b) conveying material present in the drum screen from the feed opening in the direction of a discharge opening located on a short side opposite the feed opening during rotation of the drum screen, during which transport relatively fine granular material falls through the screen wall into the drum screen, and c) discharging relatively coarse granular material at the discharge opening, wherein a vibration device that rotates along with the drum screen, which vibration device is configured to vibrate at a frequency in the ultrasonic range and comprises one or more vibrating elements mounted directly onto the drum screen, sets the drum screen vibrating in step b).

14. The method according to claim 13, wherein the drum screen forms part of a screening device according to claim 1.

15. The screening device according to claim 2, wherein the mesh width ranges between 1.0-1,000 μm.

16. The screening device according to claim 2 wherein the vibration device is configured to vibrate at a frequency in the ultrasonic range.

17. The screening device according to claim 3 wherein the vibration device is configured to vibrate at a frequency in the ultrasonic range.

18. The screening device according to claim 15 wherein the vibration device is configured to vibrate at a frequency in the ultrasonic range.

19. The screening device according to claim 2 further comprising guide means which guide material in the drum screen in a conveying direction from the feed opening to the discharge opening during rotation of the drum screen, wherein the guide means comprise a spiral present on the inner side of the drum screen.

* * * * *